United States Patent [19]

Fournet-Fayas

[11] 4,210,793

[45] Jul. 1, 1980

[54] MICROWAVE APPLICATOR FOR RADIATING MICROWAVES TO AN ELONGATED ZONE

[75] Inventor: Christian Fournet-Fayas, Bruguieres, France

[73] Assignee: Agence Nationale de Valorisation de la Recherche (A.N.V.A.R.), Neuilly sur Seine, France

[21] Appl. No.: 883,899

[22] Filed: Mar. 6, 1978

[51] Int. Cl.[2] ..... H05B 9/06

[52] U.S. Cl. ..... 219/10.55 F; 333/248; 343/772

[58] Field of Search ..... 219/10.55 A, 10.55 F, 219/10.55 M, 10.55 R; 343/767, 768, 772; 333/95 R, 95 S, 98 R

[56] References Cited

U.S. PATENT DOCUMENTS

| | | | |
|---|---|---|---|
| 3,263,052 | 7/1966 | Jeppson et al. | 219/10.55 A |
| 3,321,314 | 5/1967 | Jeppson | 219/10.55 M |
| 3,457,385 | 7/1969 | Cumming | 219/10.55 A |
| 3,704,523 | 12/1972 | Guerga et al. | 219/10.55 A |
| 3,705,283 | 12/1972 | Sayer, Jr. | 219/10.55 A |

*Primary Examiner*—B. A. Reynolds

*Attorney, Agent, or Firm*—Shlesinger, Arkwright, Garvey & Dinsmore

[57] ABSTRACT

The invention relates to a microwave applicator intended to radiate a uniform power intensity to an elongated zone of which the frequency is in a predetermined range situated around a central frequency F. This applicator includes a wave guide 1 provided with a plurality of resonant slots 4 of which the centers are separated by a distance of an even number of half wave lengths $\lambda g/2$, if $\lambda g$ is the length of guided wave corresponding to the central frequency F. The shunt slots are aligned on a longitudinal axis situated in an axial plane of the guide and are each associated with an inside post arranged in the guide on the transverse axis of said slot, so that the various slots radiate with essentially uniform amplitude. The wave guide is provided with outside posts of adjustable height penetrating into each inside post through the guide and flanges rising above the guide at the periphery of the face provided with shunt slots.

6 Claims, 6 Drawing Figures

5a
5b
5c
5d
1
1a
1'
2
3
4
4d
4p
6
7
7a
7b
7'
8
8'
a
b
x
3/9/4
7/9y
9y/2

MICROWAVE APPLICATOR FOR RADIATING MICROWAVES TO AN ELONGATED ZONE

The invention relates to a microwave applicator which is intended to radiate a microwave to an elongated zone.

Microwaves are generally meant to be waves of which the frequency is between 500 and 300,000 megahertz. These microwaves have the capacity to penetrate into material to dissipate their energy therein.

At the present time these microwaves are frequently used to effect drying of paper, plaster, textiles, etc., or cooking or defrosting of food products, etc., and so forth. At any rate, when the radiation must effect a zone of greater length, known microwave applications, particularly that disclosed in U.S. Pat. No. 3,705,283, furnish an output level which is very difficult to adjust to the desired power distribution. Moreover, the known microwave generators generate waves which vary in frequency slightly around the center frequency, and these slight variations make noticeable changes in the distribution.

A uniform distribution of the power intensity is frequently sought so as to generate a uniform treatment of the various parts of a body or material. Known devices do not permit this uniform distribution in the entire range of frequencies of the generator, and that results in great differences of treatment, according to the expanse of body or material being treated.

The present invention remedies this inconvenience by furnishing a microwave applicator which is capable of delivering a predetermined distribution of power intensity over an elongated area.

Another object of the invention is to furnish an applicator radiating a power of which the intensity is not subject to notable variations when the frequency varies in a given range surrounding a predetermined central frequency.

One particular object of the invention is to permit delivery of an essentially constant power intensity over an elongated zone in the entire range of frequencies of the waves generated by a known microwave generator.

This microwave applicator disclosed by the invention is intended to radiate a microwave on an elongated zone of L length wherein the frequency is within a predetermined ranged around a central frequency F. This applicator includes:

a wave guide of greater length than L which is adapted to guide the microwaves in the aforementioned range of frequencies, a plurality of resonant shunt slots, aligned on a longitudinal axis of the guide in its axial plane, and of which the centers are separated by a whole number of half wave length $\lambda g/2$, wherein $\lambda g$ is the length of the guided wave corresponding to the central frequency F, inside posts, each mounted in the guide on the transverse axis of and in the proximity of a slot, wherein the inside posts associated with the slots which are separated by one even number of half wave lengths $\lambda g/2$ is situated on the same side of the slots and the inside posts associated with the slots which are separated by an even number of half wave lengths, is situated opposite them, and the heights of said posts are adapted so as to create the desired power distribution along the guide, outside posts at the level of the inside posts and penetrating into the inside posts so as to permit adjustment of the height of said outside posts without modification of that of the inside posts for purposes of putting the slot radiations in phase, flanges rising above the guide on the periphery of its face and provided with shunt slots and including lateral flasks and frontal flasks such that the volume limited by said flanges and by the face of the guide provided with shunt slots is excited by the radiation in phase from said slots, for the purpose of generating a concentration of the radiated power toward the elongated area to be radiated.

In each application, the height of the inside post and the independent control of the height of the outside are effected empirically by successive approximations raising the distribution of the electric field in the area to be radiated, particularly with the aid of a quarter wave doublet and with modification of the aforementioned parameters to render this distribution as desired. Experiments have established that the applicator according to the invention can be regulated to furnish a field having very low variations, on the order of $\mp 0.25$ decibels on an area of length equal to approximately 1 meter for a central frequency equal to industrial frequency, 2450 megahertz.

This result is attained with the combination of means of the disclosed applicator, which permit excitation of an exterior volume outside the wave guide, and limited by the flanges, by means of a radiation which can be easily phase regulated to present a desired uniform distribution.

In industry, regulations of the applicator can first be studied on a prototype applicator which satisfies the requirements as foreseen, in length, power, and frequency, and once the requirements are defined to assure the desired distribution of power, the applicator can be reproduced in series.

It is to be noted that it is possible to manufacture applicators while retaining a final regulation faculty which will permit improvement of the distribution and unformity of the field, while retaining the faults or imperfections of manufacture. For this, the inside posts will be constituted of small pins which project to the inside of the guide, each provided with a limited hollow core, while the outside posts will be constituted of threaded shafts, screwed into the level of the aforementioned small pins, to penetrate more or less into them and to project to the outside of the guide to an adjustable height. The precise height of these shafts can be adjusted after manufacture of the applicators, with tests applied to each of them.

The invention is better understood relative to the following description and to the attached drawing which show one embodiment and one variation of the invention as examples.

Figures 1, 2, 3, 4:
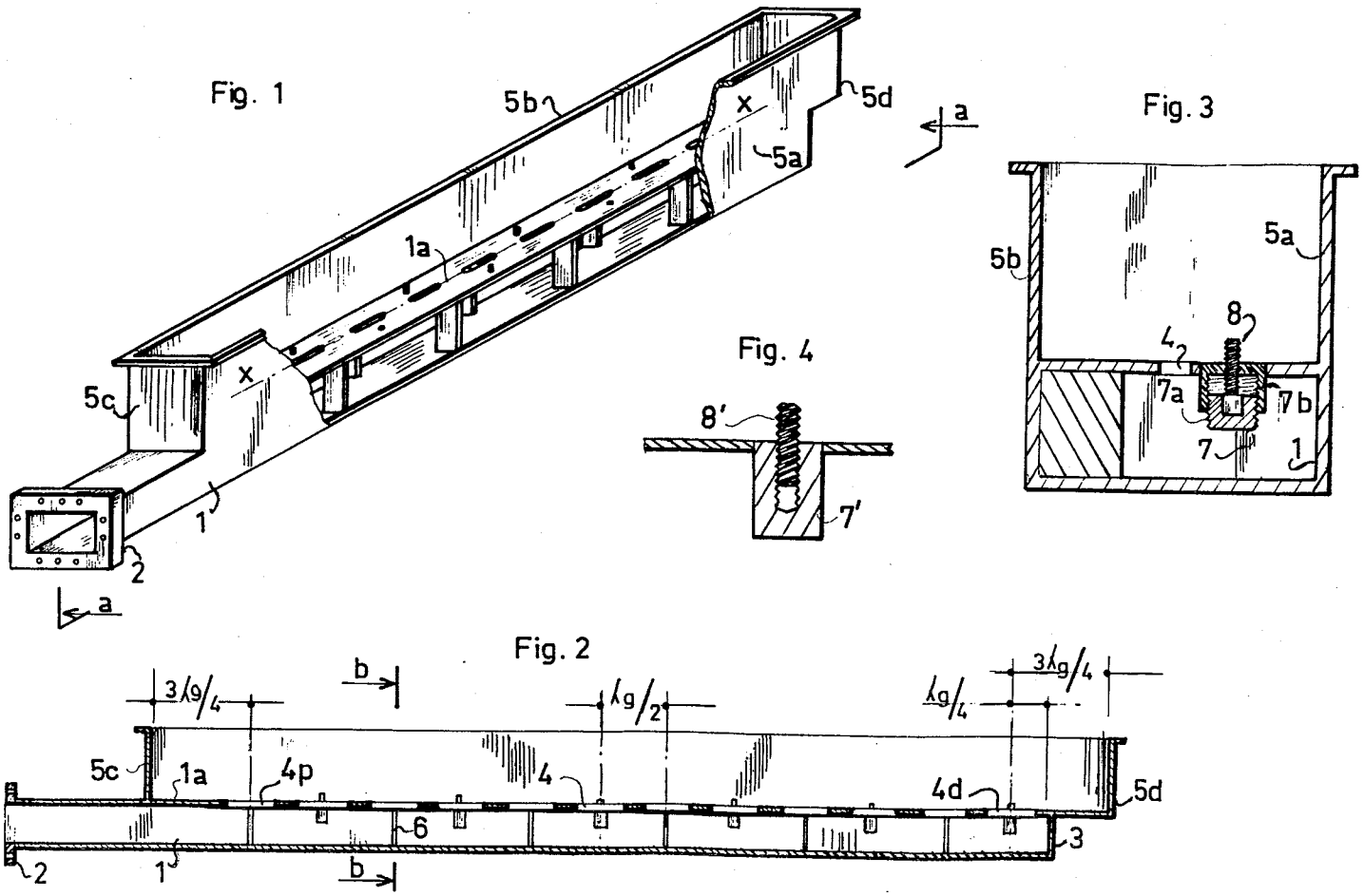
FIG. 1 is a perspective view with partial cutout of an applicator according to the invention.
FIG. 2 is a longitudinal cross section through an axial plane aa.
FIG. 3 is a transverse cross section through a transverse plane bb.
FIG. 4 is a detail of a variation.

The microwave applicator shown in FIGS. 1, 2 and 3 includes a wave guide 1 of which the length exceeds the length of the area to be covered by the radiation. This guide is adapted to guide the waves of selected frequency F, corresponding to the length of wave λg, or of a frequency near this central frequency. The guide 1 can be a rectangular cross section guide adapted to guide the waves having a frequency near industrial frequency, 2459 megahertz. The dimensions of the guide can be the following: inside transverse width: 86.36 mm, inside height: 43.18 mm, length for example: 1000 mm.

This guide is provided at its entry with a flange 2 which permits its attachment to a microwave generator or to another guide, which can also be connected to this generator.

At its other end, guide 1 is closed off by a short circuit wall 3 which permits it to enter in resonance.

On one face 1*a*, the guide has a series of resonant shunt slots 4 and so forth, aligned on the longitudinal axis xx' of this face. These slots, arranged in the longitudinal direction, are at a spacing from center to center of a half wave length λg/2. The center of the last slot 4*d*is at a distance of λλg/4 from the short circuit wall. As an example, the length of each slot can be on the order of 62.6 mm and the width on the order of 10 mm, for 2450 MHz.

The guide has flanges rising over it, which flanges 5*a*, 5*b*, extend laterally, and frontally, 5*c*, 5*d*, to concentrate the radiated power toward the elongated area to be radiated. This area is situated above the edges of these flanges. They facilitate positioning of the applicator in relation to the body to be radiated. They can also permit attachment of the radome on the applicator in order to protect it.

Side flanges 5*a* and 5*b* are situated in the extension of the straight walls of the guide, while the anterior frontal flange is situated past the input to the guide and near it, such that its distance in relation to the center of the first slot 4*p* is equal to 3λ/4, and that the posterior frontal flange 5*d* is situated before the last slot 4*d* at a distance from the center of it which is equal to 3λ/4. The height of the flanges is equal to λ/2. λ represents the wave length of the radiated wave in the air.

Baffles such as 6, constituted of transverse walls, covering a part of the section of the guide on the inside, are, additionally positioned in the wave guide to delete the reflections of the waves outside the inlet of the wave guide and avoid a return of the energy toward the generator.

An inside post such as 7 is associated with each shunt slot and is situated in immediate proximity with it on the transverse axis. The outside posts such as 8 are attached to the outside of guide 1 to the right of some posts 4.

In the absence of posts 7, the shut slots 4 would not radiate or would radiate with a very reduced amplitude because of their axial position on axis xx' of the guide. Posts 7 allow them to radiate, and the height of each post is adapted so that the radiation is effected with equal amplitude for all of the slots. So that all of the power entering the wave guide will be radiated, the regulation is effected in such a manner that each slot radiates 1/N of the total power entering the guide, if N is the number of slots. Also, so that two adjacent slots separated by a distance of λg/2 do not radiate in opposite phase, inside posts 7 are positioned alternately on each side of successive slots. The radiation emitted by one slot is thus carried in phase in relation to the radiation of the adjacent slot.

It has been shown that in practice it is easy to regulate the height of each post to obtain an essentially constant amplitude of radiation.

At any rate, in the absence of outside posts 8, the radiations emitted by the various slots attain the area to be radiated out of phase, and it is established that large hollows occur in the distribution of the field at this level. By realizing a return to phase of these radiations, outside posts 8 allow elimination of these hollows and excitation of the outwise volume delimited by flanges 5*a*, 5*b*, 5*c*, 5*d*, and by face 1*a*, to obtain an essentially constant distribution at the level of the open face of this volume.

FIG. 3 shows a theoretical applicator allowing experimental definition of the regulations to be effected. For this, each inside post 7 is provided with a limited hollow core and a casing 7*b*, attached to the wave guide. Guide 7*a* is screwed into casting 7*b* so as to be able to regulate the depth at which this guide projects to the interior of the wave guide.

Each post 8 is constituted of a threaded shaft screwed in a threaded hole of the casing 7*b*. This shaft can penetrate more or less into outside retainer 7*b* and in the hollow core of guide 7*a* to project to the outside of the guide at an adjustable height.

Once the height of guides 7*a* and that of the threaded shaft in such an applicator are defined for each applicator, it is possible to realize simplified manufacture, particularly by providing inside posts 7' of suitable height, soldered onto the wave guide and provided with threaded holes opening on the outside for the fitting of a threaded shaft 8' as in FIG. 4. This shaft allows the realization of precise regulation of each applicator, while assuring perfect phase setting of radiations on the area to be radiated.

Figure 5:
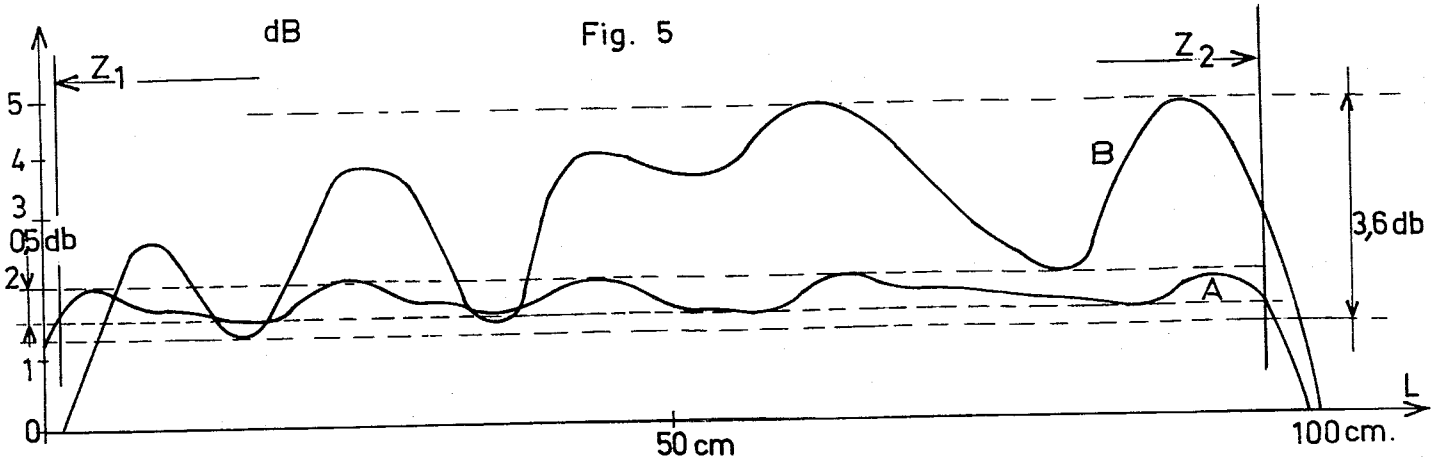
FIG. 5 shows comparative curves of variations of the field as a function of the position along the applicator in the case of an applicator according to the invention regulated to furnish a uniform field, curve A, and in the case of a comparable traditional applicator, curve B.
Figure 6:
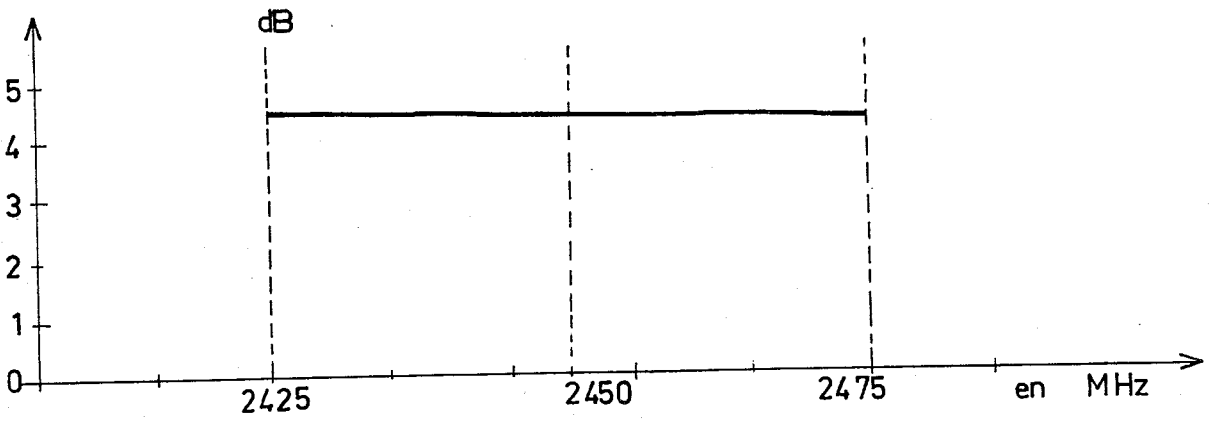
FIG. 6 shows a curve giving the variations of the field as a function of the frequency.

The curves of FIG. 5 and 6 show the results attained by the invention.

Curves A and C, in the case of the invention, show the decibel variations of the power radiated in the radiated area, on the one hand, as a function of the position along the applicator, and on the other hand, as a function of the frequency for a given point of the radiated area. These curves have been raised for an applicator according to the invention of the type described, functioning at a central frequency of 2450 megahertz and regulated to furnish a uniform power on the area to be radiated. The intensity of the field has been measured by means of a quarter wave doublet antenna mounted several centimeters above the flanges.

On curve A, the lengths are shown in abcissa in centimeters. In the useful zone $Z_1Z_2$, the field does not vary beyond ∓ 0.25 decibels in relation to its mean value, the difference of intensity of power of ∓ 5% in relation to the mean value.

By comparison, curve B is shown on the same drawing, furnished in the same conditions with a traditional applicator of the type in which the same conditions with a traditional applicator of the type in which the shunt slots are situated on the bare guide in the resonance amplitude zones on one end and the other sides of this face.

The variations of the field are in this case on the order of ∓ 1.8 decibels, which is shown translated by differences of power of more than ∓ 33% in relation to the mean value.

Thus in the case of the invention, the treatment of a material of a body placed in the radiated zone is essentially uniform in the heart of the zone because the dissipated energy is constant whatever be the point where it is placed. This is not the case while using a traditional applicator which produces a differential treatment as a function of the position of the various points of the material or body being treated.

FIG. 6 shows variations in decibels of the radiator power as a function of the frequency, for one point of the radiated zone, in the case of the invention, curve C. There is practically no variation.

Thus in a frequency range of ∓ 25 megahertz from the central frequency of 2450 megahertz, the applicator of the invention furnishes at each point an essentially constant power intensity. This advantage is important in practice because present microwave generators by their construction do not provide frequency stability. For example, industrial generators emitting at 2450 megahertz will vary between ∓ 25 megahertz from the center frequency.

Of course the invention is not limited to the preceding description but includes all of its variations.

I claim:

1. A microwave applicator for irradiation an elongated zone of the length L with energy having a frequency range around a central frequency F comprising:

a wave guide adapted to guide microwaves within said frequency range, said wave guide having a length greater than L, a plurality of resonant shunt slots in said wave guide and arranged on a longitudinal axis of said wave guide in the axial plane, the centers of said slots being separated by a distance equal to a whole number of half wave length $\lambda g/2$, wherein $\lambda g$ is the length of the guided wave corresponding to the frequency F, inside posts within said wave guide on the transverse axis of said slots and adjacent thereto, wherein said inside posts associated with slots separated by an uneven number of half wave length are on opposite sides of said slots and the heights of said inside posts are such as to provide a desired power distribution along the wave guide, outside posts positioned outside of said wave guide and at the same points as said inside posts, said inside posts including a guide member projecting into said wave guide, and said outside posts including a threaded shaft passing through the wall of said wave guide and projecting outwardly thereof and inwardly thereof into said guide members, whereby the height of said outside posts are adjustable independently of the heights of said inside posts, and a flange member comprising lateral flanges and frontal flanges extending from the periphery of said wave guide and surrounding said shunt slots such that the volume defined by said flange member and the face of said wave guide having said shunt slots is excited by the radiation in phase from said shunt slots for applying a uniform predetermined power intensity having only slight variation with frequency to an elongated zone adjacent said flange member.

2. A microwave applicator as in claim 1, wherein said guide members are screwed onto casings attached to said wave guide, so as to be regulatable independently from the outside posts .

3. A microwave applicator as in claim 1, wherein said side flanges extend in the same plane as the two lateral faces on the wave guide contiguous to the face provided with said shunt slots.

4. A microwave applicator as in claim 1, wherein said frontal flanges are orthoganal to the face of said wave guide having said shunt slots and are situated at a distance equal to $3\lambda/4$ from the center of the first and of the last slot, wherein $\lambda$ is the length of the wave radiated in the air.

5. A mircowave applicator as in claim 1, wherein the height of the flanges above the face of said wave guide having said shunt slots is approximately equal to $1\lambda/2$, wherein $\lambda$ is the length of the wave radiated in the air.

6. A microwave applicator as in claim 1, and including baffles arranged in said wave guide to reduce the reflections of the radiation beyond the entry of the wave guide.

* * * * *